US012589906B2

(12) United States Patent
Greer et al.

(10) Patent No.: US 12,589,906 B2
(45) Date of Patent: Mar. 31, 2026

(54) PACKAGE WITH PUSH TAB LOCKING MECHANISM

(71) Applicant: Digital Marketing Services, Inc., Pelham, AL (US)

(72) Inventors: Matthew William Greer, Hoover, AL (US); Ryan Christopher Cooper, Bend, OR (US); David Anthony Rula, Birmingham, AL (US)

(73) Assignee: DIGITAL MARKETING SERVICES, INC., Pelham, AL (US)

( * ) Notice: Subject to any disclaimer, the term of this patent is extended or adjusted under 35 U.S.C. 154(b) by 0 days.

(21) Appl. No.: 18/495,267

(22) Filed: Oct. 26, 2023

(65) Prior Publication Data

US 2024/0140641 A1 May 2, 2024

Related U.S. Application Data

(60) Provisional application No. 63/419,543, filed on Oct. 26, 2022.

(51) Int. Cl.
*B65D 5/38* (2006.01)
*B65D 5/02* (2006.01)
(Continued)

(52) U.S. Cl.
CPC ..... *B65D 5/38* (2013.01); *B65D 5/0227* (2013.01); *B65D 5/04* (2013.01); *B65D 5/20* (2013.01);
(Continued)

(58) Field of Classification Search
CPC ..... B65D 5/38; B65D 5/503; B65D 5/5038; B65D 50/046; B65D 2215/02; B65D 5/0227; B65D 5/04
(Continued)

(56) References Cited

U.S. PATENT DOCUMENTS

D878,197 S 3/2020 Griffin et al.
D899,247 S 10/2020 Kilduff et al.
(Continued)

FOREIGN PATENT DOCUMENTS

CN 213168926 U 5/2021
CN 116280587 A 6/2023

OTHER PUBLICATIONS

Studio on Fire—Craft Lock Box, Date first available: Nov. 30, 2021, site visited: Apr. 9, 2024, Available online: <URL: https://www.Studioonfire.com/craft-lock-box>, (Year 2021)*.
(Continued)

*Primary Examiner* — Luan K Bui
(74) *Attorney, Agent, or Firm* — STAAS & HALSEY LLP

(57) ABSTRACT

A package including an outer box and inner tray. The inner tray slidable into and out of the outer box. The outer box including a first tab, a second tab, and a lip. The first and second tabs movable toward an interior of the outer box when force is applied. The inner tray including a first flap and a second flap, the first and second flaps movable toward an interior of the inner tray when force is applied. When the inner tray is slid into the outer box and the first and second tabs are in a first position, the first and second flaps are engaged with the lip and the inner tray is locked to the outer box. When the first and second tabs are in a second position the first and second flaps are disengaged with the lip and the inner tray is slideable out of the outer box.

9 Claims, 18 Drawing Sheets

(51) Int. Cl.

| | |
|---|---|
| ***B65D 5/04*** | (2006.01) |
| ***B65D 5/20*** | (2006.01) |
| ***B65D 5/42*** | (2006.01) |
| ***B65D 5/50*** | (2006.01) |
| ***B65D 83/04*** | (2006.01) |

(52) U.S. Cl.
CPC ..... *B65D 5/4279* (2013.01); *B65D 5/503* (2013.01); *B65D 2215/02* (2013.01)

(58) Field of Classification Search
USPC ..... 206/1.5, 468; 229/125.125
See application file for complete search history.

(56) References Cited

U.S. PATENT DOCUMENTS

| | | | | |
|---|---|---|---|---|
| 10,919,663 | B2 * | 2/2021 | Jones | B31B 50/26 |
| D922,195 | S | 6/2021 | Altman et al. | |
| D932,891 | S | 10/2021 | Chambers et al. | |
| D986,056 | S | 5/2023 | Richardson et al. | |
| 2017/0297803 | A1 * | 10/2017 | Chambers | B65D 5/0254 |
| 2018/0257827 | A1 * | 9/2018 | Drosos | B65D 50/066 |
| 2020/0102113 | A1 | 4/2020 | Laughlin | |
| 2020/0180808 | A1 * | 6/2020 | Gauvin | B65D 5/38 |
| 2020/0262618 | A1 * | 8/2020 | Nelson | B65D 5/38 |
| 2021/0016939 | A1 * | 1/2021 | Palmer | B65D 5/38 |
| 2021/0107712 | A1 * | 4/2021 | Chambers | B65D 5/38 |

OTHER PUBLICATIONS

Amazon's Plain White Slide Tray Match Type Candy Storage Favor Boxes. Date first available: Nov. 26, 2013. Site visited: Apr. 9, 2024. Available online: <URL: https://www.amazon.com/Plain-White-Cardboard-Slide-Storage/dp/B00GXCV5V2?language=en_US> (Year: 2013)*.

US Ex Parte Quayle Office Action issued in co-pending U.S. Application No. 29/8591747 dated Apr. 25, 2024.

U.S. Appl. No. 29/857,177, filed Nov. 8, 2022, Matthew William Greer, Digital Marketing Services, Inc.

* cited by examiner

Bottom View of Outer Box (100)

Top View of Inner Tray (200) and Top View Outer Box (100), with Inner Tray (200) Partially Inserted into Outer Box (100)

PACKAGE WITH PUSH TAB LOCKING MECHANISM

CROSS-REFERENCE TO RELATED APPLICATIONS

This application claims the benefit of U.S. Provisional Application No. 63/419,453, filed Oct. 26, 2022, the contents of which is incorporated herein by reference in its entirety.

BACKGROUND

Items such as medicine, tobacco, and cannabidiol (CBD) products may often be stored in packages (may also be referred to as containers) to be distributed or sold. Since the content of these packages may pose a safety risk for certain members of the public (e.g., children) it is desirable to limit access to the contents of the package through a locking mechanism. Packages with such locking mechanisms may be referred to as tamper resistant packaging. A tamper resistant packaging is a packaging that is designed and constructed to be significantly difficult for certain members of the public (e.g., children) to open or obtain items from the package within a reasonable time.

Presently, locking mechanisms for tamper resistant packages, may take up an area of the packaging which otherwise could be utilized for labeling or advertising purposes. When a printing is applied to these locking mechanisms, the printing may not be aesthetically pleasing because of the uneven surface which makes the printing look uneven.

Additionally, the locking mechanism may a separate component that is added to the package. Therefore, it is desirable to have a locking mechanism for packages that is not obtrusive and allows for efficient use of package space for labeling or advertising. Having a locking mechanism that is incorporated into the package may be desirable to lower the cost of manufacturing of the package.

BRIEF DESCRIPTION OF DRAWINGS

The concepts, principles, method, specifications, embodiments and salient features of the invention are illustrated by way of examples, and not by way of any limitation, in the below listed FIGURES along with their drawings and detailed descriptions, wherein like reference numerals refer to similar elements. Various aspects and advantages will become more apparent and more readily appreciated from the following description of example embodiments, taken in conjunction with the accompanying drawings, of which.

DETAILED DESCRIPTION

Described herein are examples of a package with a locking mechanism. Hereinafter, an example of a package that includes an outer box (100) and an inner tray (200) will be described in detail with reference to the accompanying drawings.

Figure 1A:
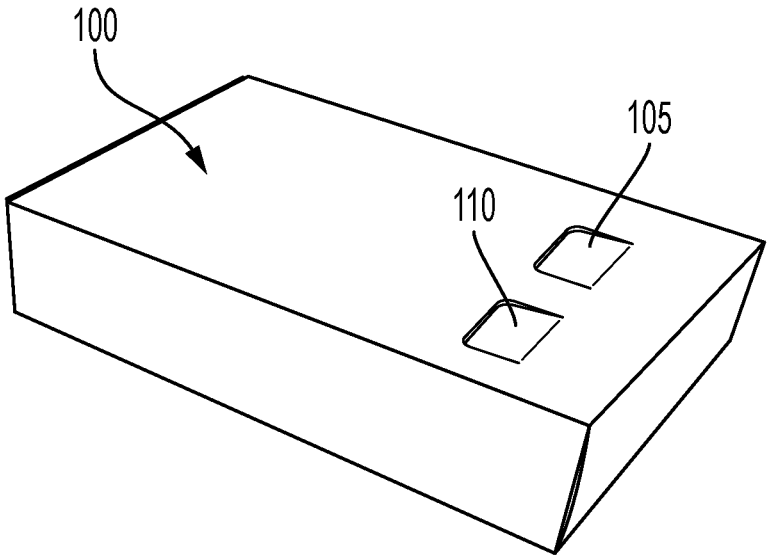
FIG. 1A is a depiction of bottom of an outer box, according to an example.
Figure 1B:
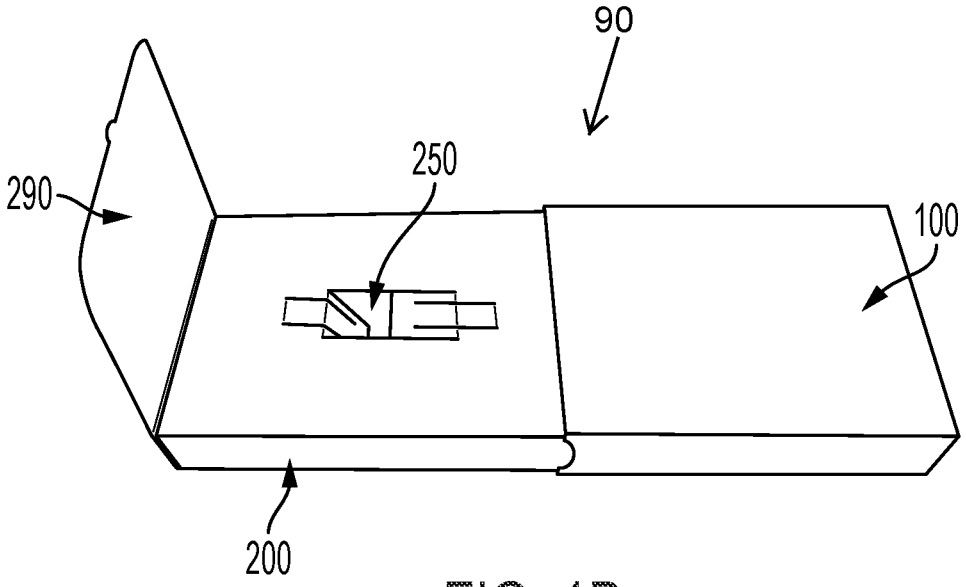
FIG. 1B is a depiction of top of an inner tray and top of an outer box, of a package, according to an example.

FIG. 1A is a depiction of a top of an outer box, according to an example. FIG. 1B is a depiction of top of an inner tray and top of an outer box, of a package, according to an example. The references to top and bottom of the package 90 are in relation to an orientation of the package (90) so that the top of the outer box (100) may be visible facing a user, and a top of the inner tray (200) where the tray insert (250) is disposed may be accessible to the user, for example, when the inner tray (200) is slid out of the outer box (100) in response to pressing of the first tab (105) and the second tab (110) which releases the locking of the inner tray (200) when disposed inside the outer box (100), so that tray insert (250) may be exposed for use while the inner tray (200) is slid out of the outer box (100).

Figure 2A:
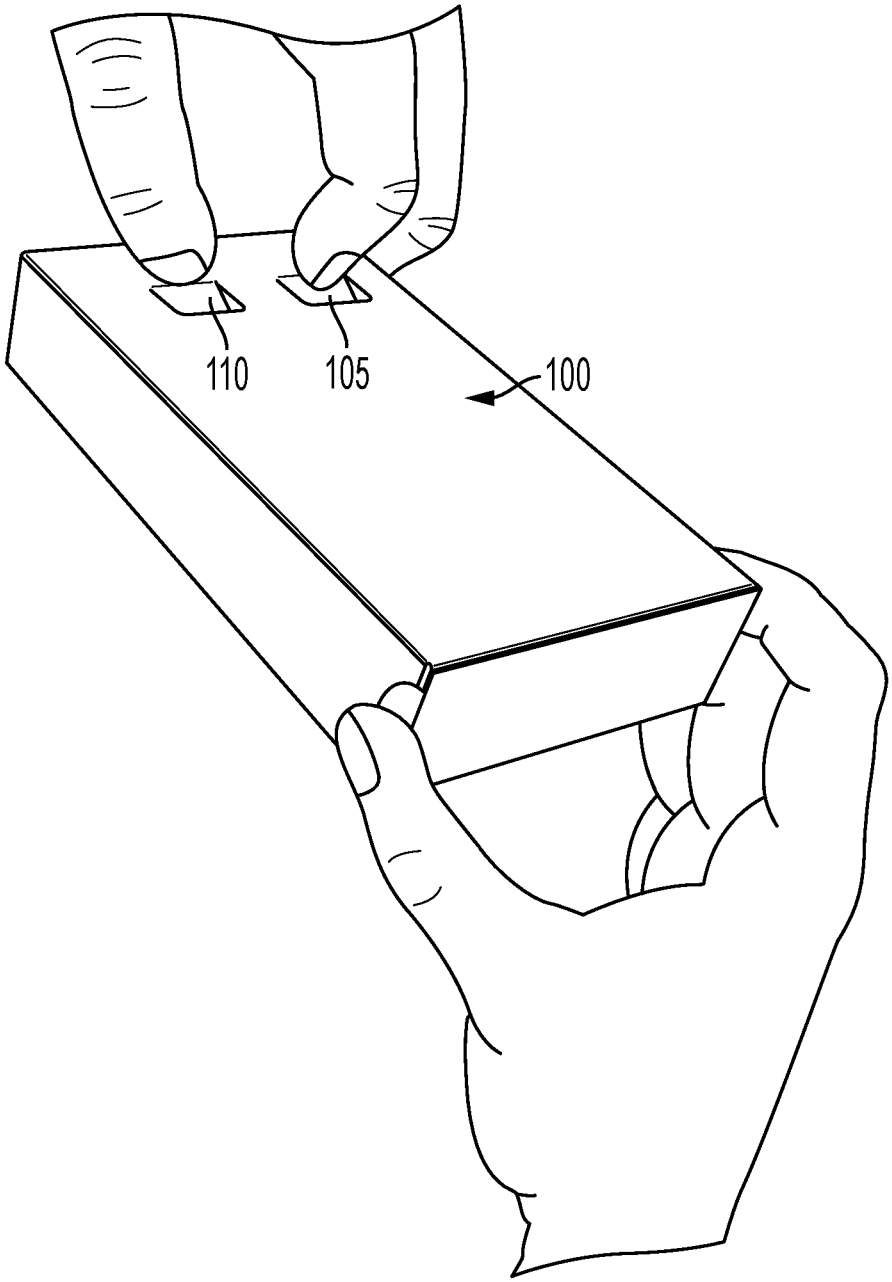
FIG. 2A is a first view of the first tab and the second tab unlocking the inner tray from the outer box, according to an example.
Figure 2B:
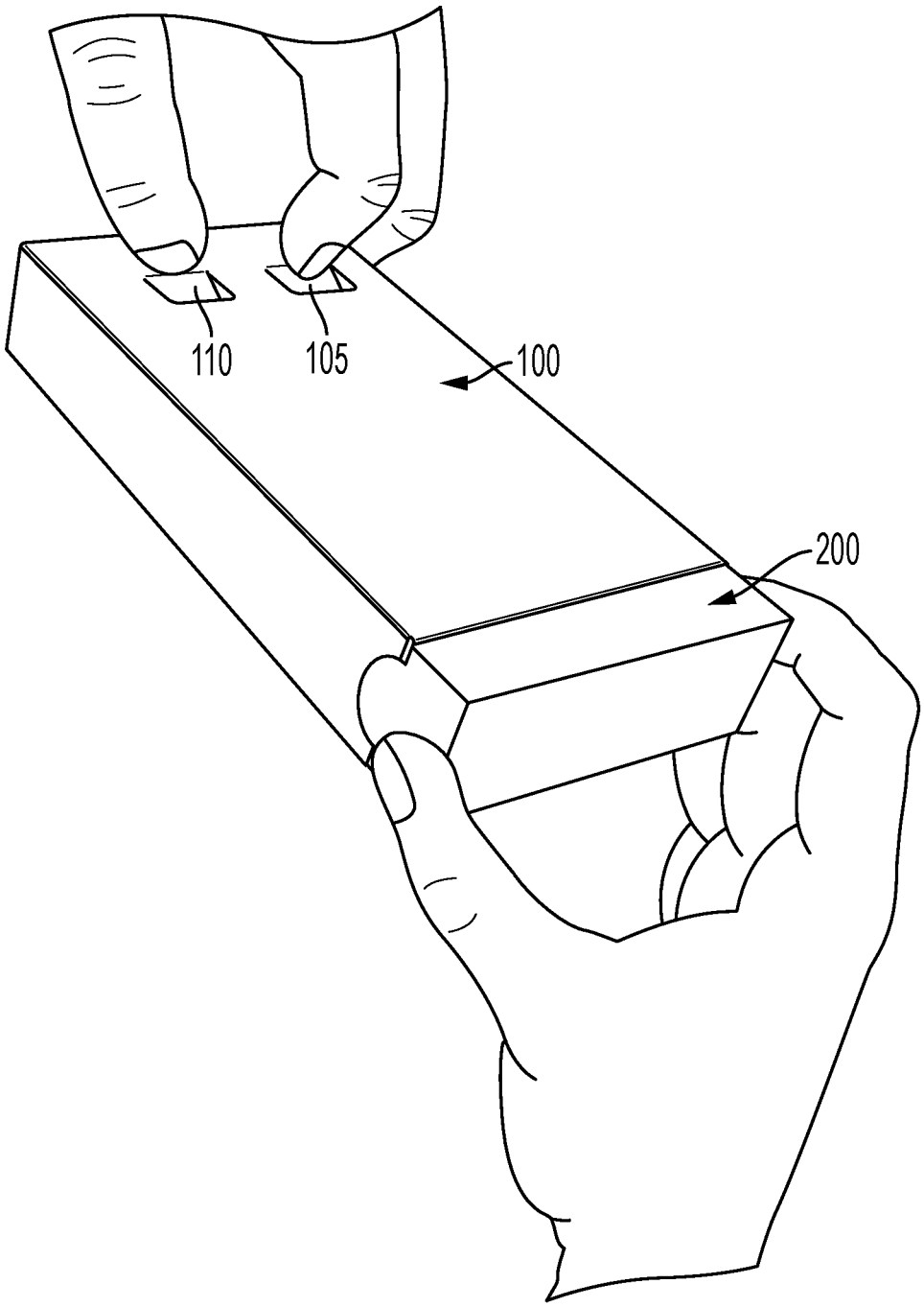
FIG. 2B is second view of the first tab and second tab unlocking the inner tray from the outer box, according to an example.

A package 90 (FIG. 1B) comprising an outer box (100) having a cuboid shape and including a top panel of the top panel (125) of the outer box (100) and a bottom panel (115) of the outer box (100). The bottom panel (115) of the outer box (100) having a first tab (105) and a second tab (110) positioned on an outer surface of the bottom panel (115) of the outer box (100). The first tab (105) and the second tab (110) are movable toward an interior of the outer box (100) when a force is applied on the first tab (105) and the second tab (110) toward the interior of the outer box. The first tab (105) and the second tab (110) are also retractable away from the interior of the outer box (100) when the force is removed. For example, as shown in FIG. 2A and FIG. 2B, a user may simultaneously use two fingers on the first tab (105) and the second tab (110) to push the tabs down toward the interior of the outer box (100). The geometry of the first tab (105) and/or the second tab (110) may be any shape, for example, square or rectangular.

A package 90, comprising: an outer box (100) including a first tab (105), a second tab (110), and a first lip (155) formed along an interior top surface of a bottom panel (115) of the outer box 100 to extend towards the interior of the outer box 100. The package including an inner tray (200) slidable into and out of the outer box (100). The inner tray (200) including a first flap (205) and a second flap (210). Wherein the first tab (105) and the second tab (110) are movable toward an interior of the outer box (100) and when a force is applied on the first tab (105) and the second tab (110), the first flap (205) and the second flap (210) are moved toward the interior of the outer box against the bottom panel of the inner tray (200), so that the first flap (205) and the second flap (210) are engaged with the lip causing the inner tray (200) to be locked to the outer box (100) and when the force is not applied to the first tab (105) and the second tab (110), the first flap (205) and the second flap (210) are unengaged with the lip causing the inner tray (200) to be slideable out of the outer box (100).

As shown in FIG. 1A, in an example, the first tab (105) and the second tab (110) may be positioned on a bottom side of the outer box (100). That is the first tab (105) and the second tab (110) may be formed along a bottom panel (115) of the outer box (100). That is, the first tab (105) and the second tab (110) may be positioned along the bottom of the package.

An outer box (100) also includes a first lip (155) having a rectangular shape. The first lip (155) may be glued or attached to interior top surface of the bottom panel (115) of the outer box (100) by an adhesive or film adhesive. The first lip (155) being glued or attached to the interior top surface of the bottom panel (115) of the outer box (100) improves the rigidity and durability of the outer box (100). When the first lip (155) is glued to the interior top surface of the bottom panel (115) of the outer box (100), the first lip (155) protrudes in a direction toward the interior of the outer box (100).

The outer box (100) also including an open side into which the inner tray (200) slides into and out of the outer box (100).

In an example, a package (90) having a cuboid shape includes an outer box (100) including a first tab (105), and a second tab (110), the first tab and the second tab moveable towards an interior of the outer box, and a first lip (155) disposed on an interior top surface of a bottom panel of the outer box; and an inner tray (200) slidable into and out of the outer box, the inner tray including a first flap (205), and a second flap (210). The first flap (205) and the second flap (210) are respectively engageable with the first tab and the second tab, so that when a force is applied on the first tab (105) and the second tab (110) to respectively contact the first flap and the second flap, the first flap and the second flap are respectively moved toward the interior of the outer box against the bottom panel of the inner tray to be disengaged from the first lip (155), causing the inner tray to be unlocked and slidable out of the outer box, and when the force is not applied to the first tab and the second tab, the first flap and the second flap are engaged with the first lip (155) causing the inner tray to be locked inside the outer box.

Figure 4A:
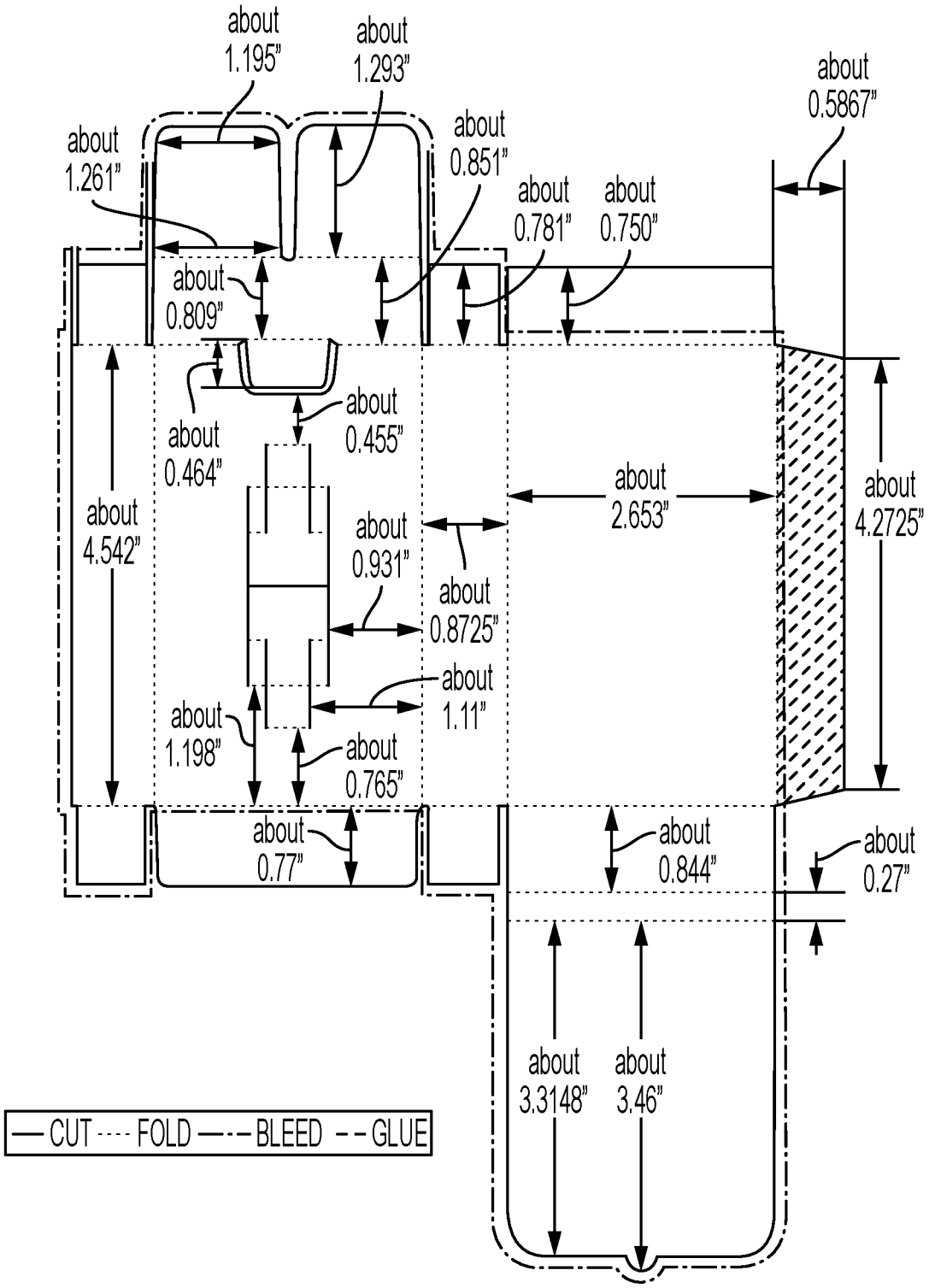
FIG. 4A is a diagram of an unassembled inner tray, according to an example.
Figure 5A:
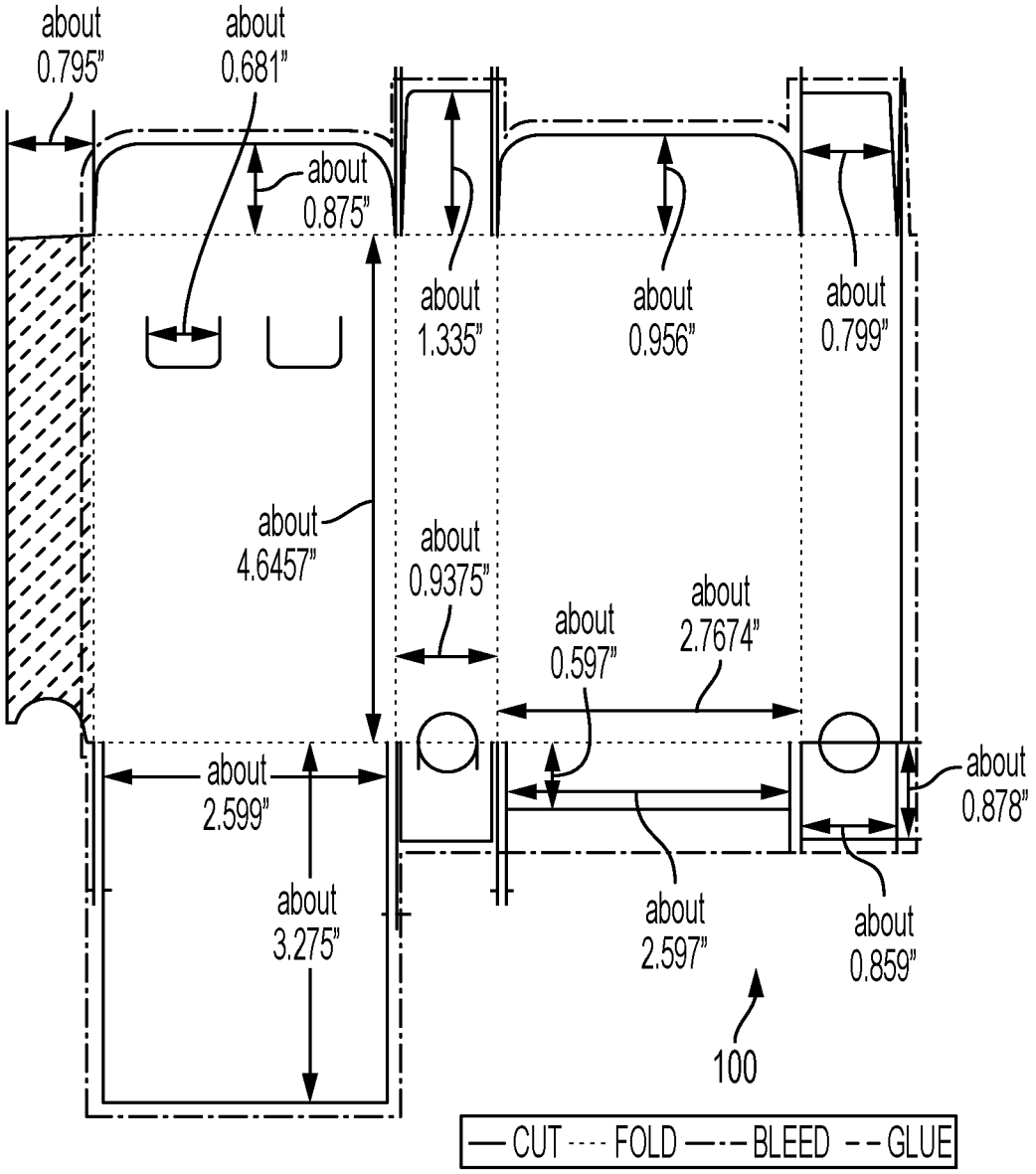
FIG. 5A is a diagram of an unassembled outer box, according to an example.

FIG. 4A is a diagram of an unassembled unfolded inner tray, according to an example. FIG. 5A is a diagram for an outer box (100) unassembled unfolded, according to an example. The dimensions in FIGS. 4A and 5A are in inches. In the examples, measurements of various portions of outer box (100) are shown. The measurements shown in FIGS. 4A and 5A may be adjusted based on sizes of the outer box (100) and the inner tray (200) to correlate to each other.

FIG. 4A is a non-limiting example of diagram for an inner tray (200) unassembled, unfolded, which shows measurements of various portions of inner tray (200) and are non-limiting. The measurements shown in FIG. 4A may be adjusted based on the contents stored in the inner tray (200).

Figure 4B:
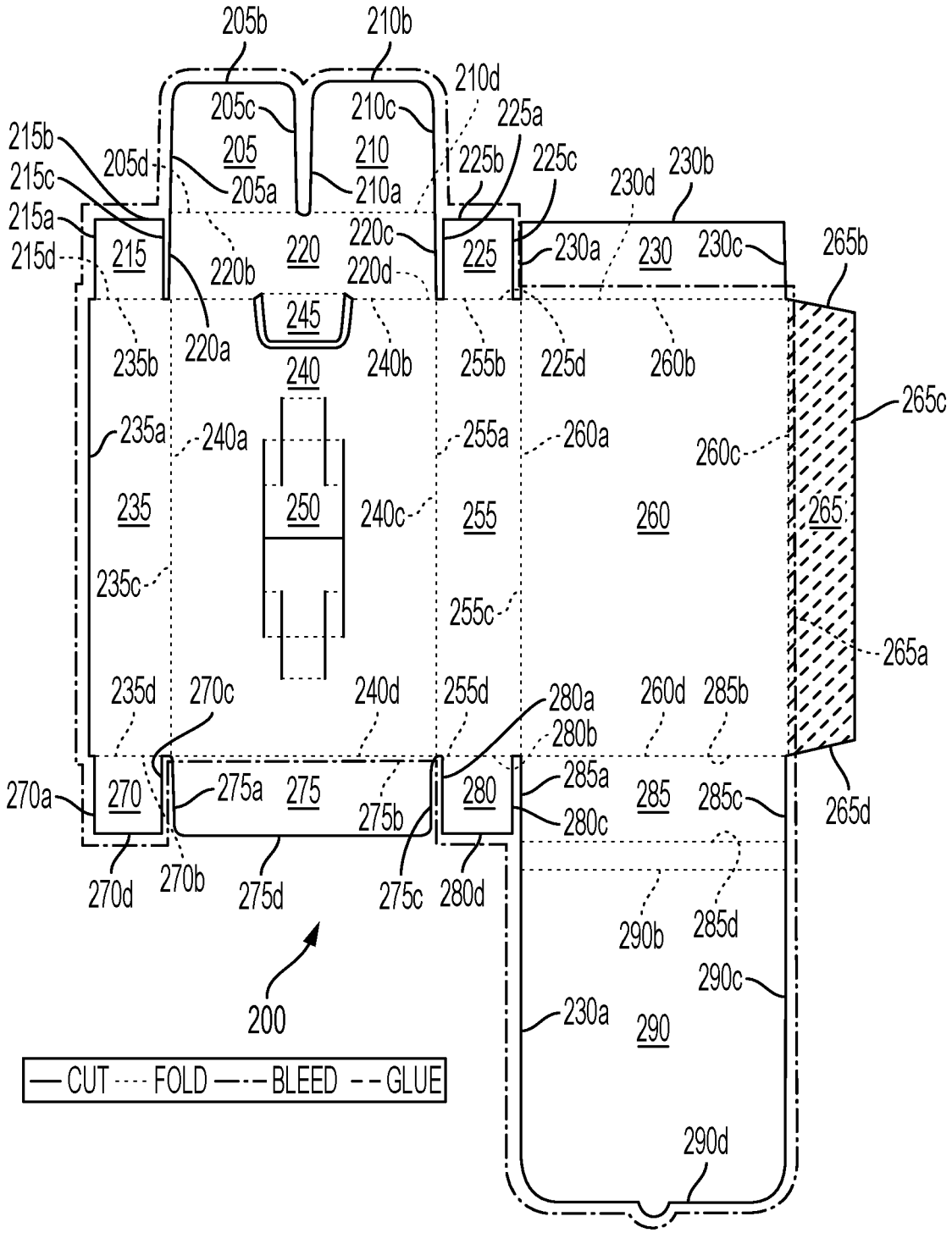
FIG. 4B is a diagram of an unassembled inner tray, according to an example.

FIG. 4B is a non-limiting example of diagram for an inner tray (200) unassembled unfolded. FIG. 4B shows the fold lines, cut lines, bleed lines, and glue/adhesives areas used for the inner tray (200). The fold lines, cut lines, bleed lines, and glue/adhesives shown in FIG. 4B may be adjusted based on the contents stored in the inner tray (200).

Figure 5B:
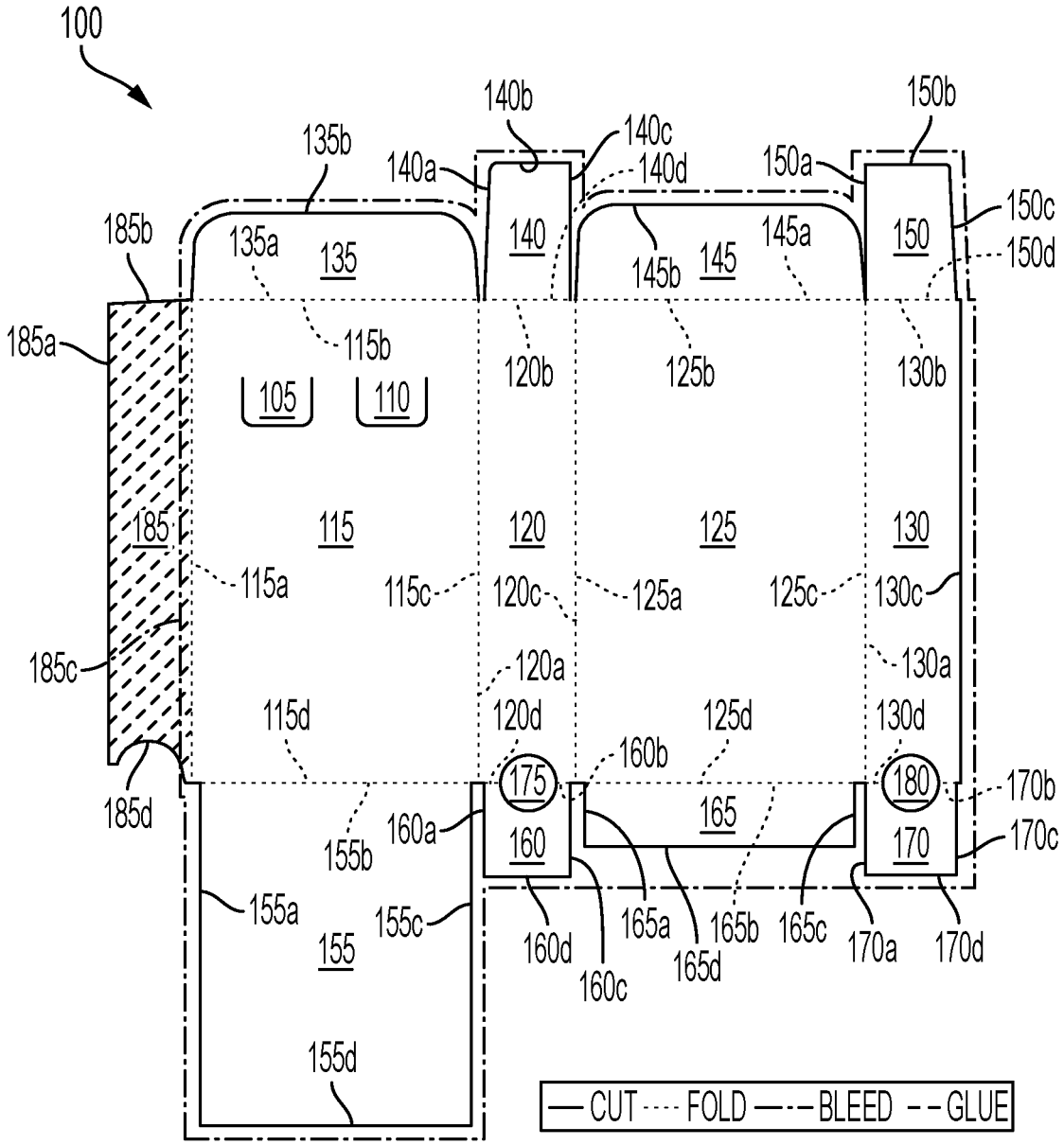
FIG. 5B is a diagram of an unassembled outer tray, according to an example.

FIG. 5B is a diagram for an outer box (100) unassembled unfolded, according to an example. In the example, the fold lines, cut lines, bleed lines, and glue/adhesives areas used for the outer box (100). The fold lines, cut lines, bleed lines, and glue/adhesives shown in FIGS. 5A and 5B may be adjusted based on the size of the inner tray (200).

Figure 6A:
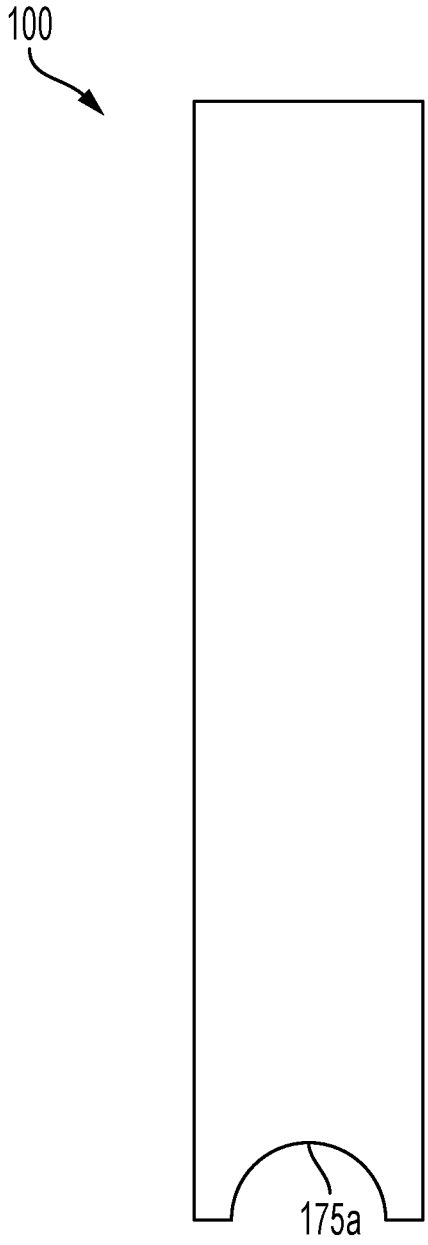
FIG. 6A is a first side view of the outer box, according to an example.

FIG. 6A is depiction of the outer box (100), according to an example. In the example, the first finger hold (175*a*) is formed along the open end of the outer box (100). The first finger hold (175*a*) is formed along the first side wall (120).

Figure 6B:
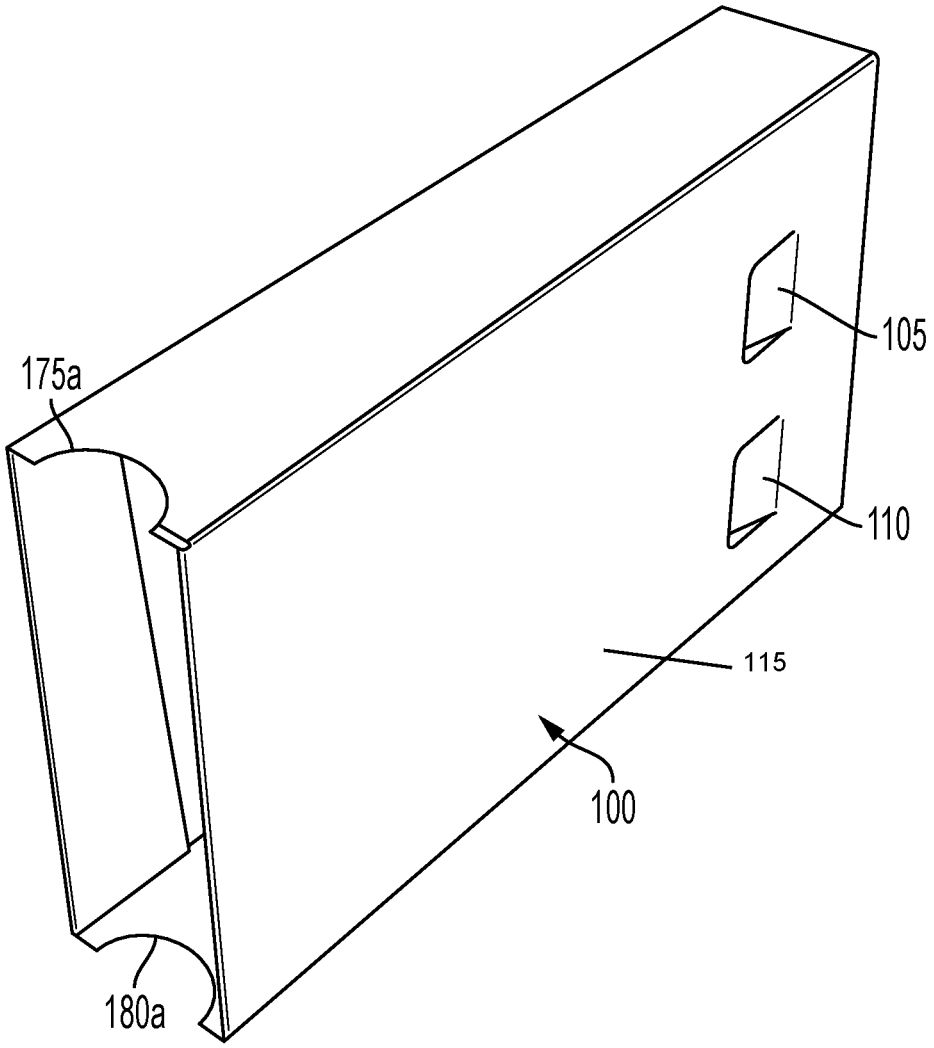
FIG. 6B is a second side view of the outer box, according to an example.

FIG. 6B is depiction of the outer box (100), according to an example. In the example, FIG. 6B shows the first tab (105) and the second tab (110) positioned along the bottom panel (115) of the outer box (100). Likewise, the first finger hold (175*a*) and the second finger hold (180*a*) are shown in FIG. 6B. The first finger hold (175*a*) is formed along the first side wall (120). The second finger hold (180*a*) is formed along the second side wall (130).

Figure 6C:
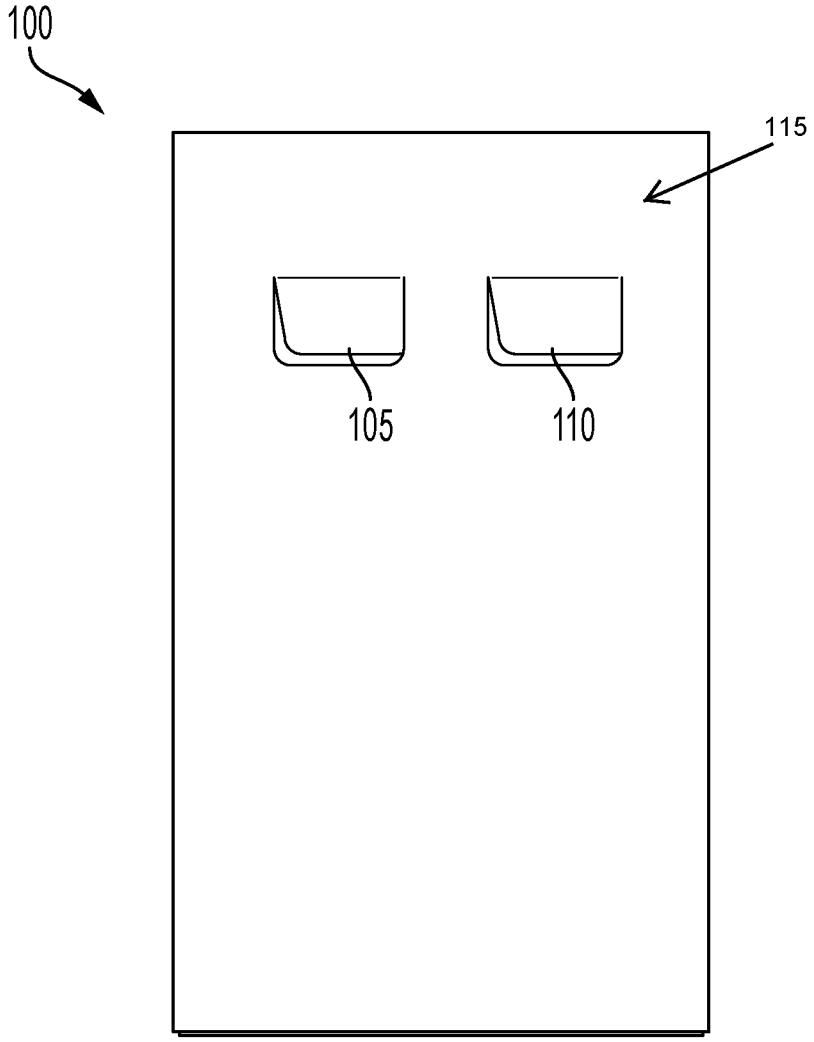
FIG. 6C is a top view of the outer box, according to an example.

FIG. 6C is a depiction of the outer box (100). In the example, FIG. 6C shows the first tab (105) and the second tab (110) along the bottom panel (115) of the outer box (100).

Figure 3A:
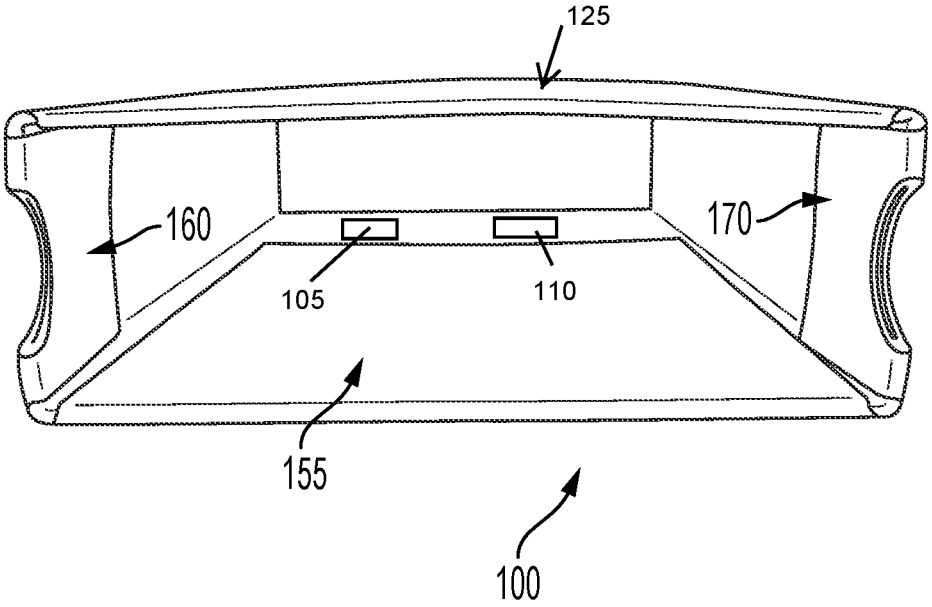
FIG. 3A is a first view of the interior of the outer box, according to an example.

FIG. 3A, is a depiction of an interior the outer box (100). In the example, FIG. 3A shows the interior of the outer box (100). Specifically, the position of the first lip (155) attached to the bottom panel (115) of the outer box (100). Likewise, the position of the third dog ear (160) and the fourth dog ear (170) are also shown. The positioning of the first lip (155) improves the rigidity of the outer box.

Figure 3B:
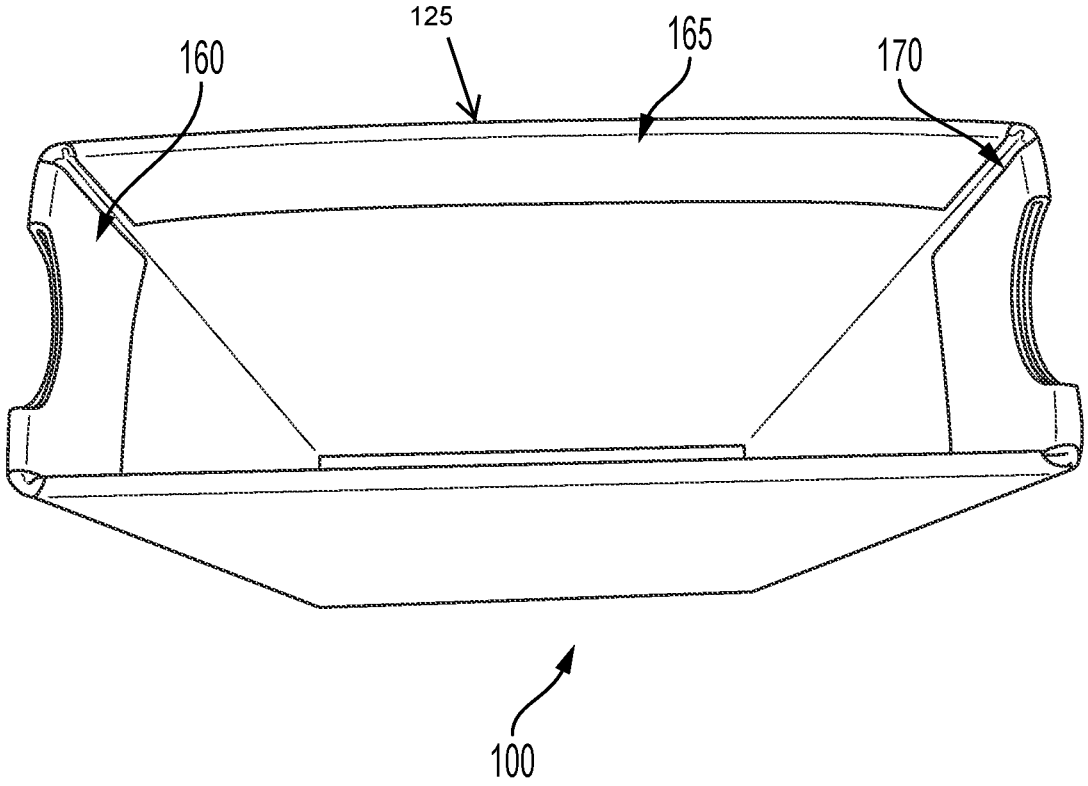
FIG. 3B is a second view of the interior of the outer box, according to an example.

FIG. 3B is a depiction of the interior of the outer box (100). In the example, FIG. 3B shows the interior of the outer box (100). Specifically, the second lip (165) is shown attached along the interior top surface of the top panel (125) of the outer box. Likewise, the position of the third dog ear (160) and the fourth dog ear (170) are also shown. The positioning of the second lip (165) improves the rigidity of the outer box. The second lip (165) is across from the first lip (155) along the interior of the outer box (100).

Figure 3C:
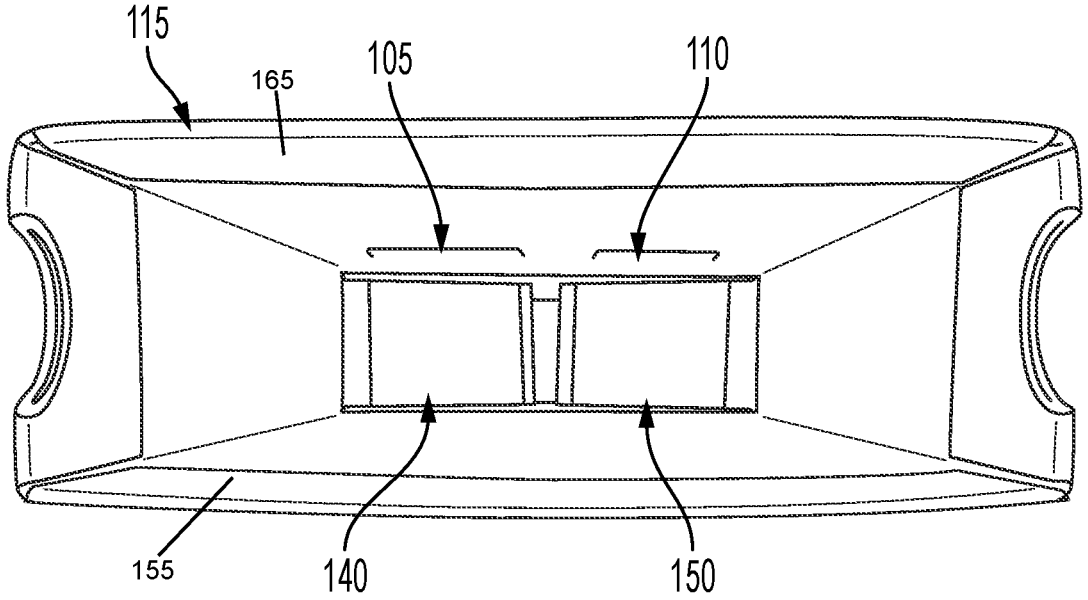
FIG. 3C is a third view of the interior of the outer box, according to an example.

FIG. 3C is a depiction of the interior of the outer box (100). In the example, FIG. 3C, the first tab (105) and the second tab (110) are shown formed along the bottom panel (115) of the outer box (100). Additionally, the first dog ear (140) and second dog ear (150) form a closed end of the outer box.

The package also comprises an inner tray (200) having a cuboid shape. The inner tray (200) is slidable into and out of the outer box (100) through the open side of the outer box (100). For example, the inner tray (200) may be slid in and out of the outer box (100) by the user, when unlocked from the outer box (100).

The inner tray (200) includes a top panel (240) having an tray insert (250) to hold items such as medicine, CBD products, or other goods and products. The inner tray (200) also includes a bottom panel (260), a first flap (205), and a second flap (210) formed along a first side panel (220). The top panel (240) and the bottom panel (260) form the top side and the bottom side of the inner tray respectively.

Additionally, the inner tray may have a cover flap (290) which is used to cover the insert tray. The cover flap (290) may be used to cover and uncover the tray insert (250). FIG. 1B illustrates an example of the cover flap (290) uncovering the tray insert (250). Likewise, the cover flap may lay on the inner tray and cover the tray insert (250).

The inner tray may also include a third flap (245) formed with a top surface area of the top panel (240) of the inner tray 200. The third flap (245) is positioned at the front of the inner tray 200 when inserted into the outer box 100 and prevents the inner tray from being completely removed from the outer box (100). Specifically, the third flap (245) engages with the second lip (165) of the outer box (100), so that the inner tray (200) is prevented from being completely withdrawn out of the outer box (100).

The inner tray (200) also includes a first flap (205) and a second flap (210). The first flap (205) and the second flap (210) are positioned on the bottom side of the inner tray. The first flap (205) and the second flap (210) are movable toward the bottom panel (260) of the inner tray (200) and the interior of the outer box (100) when a force is applied on the first flap (205) and the second flap (210). The first flap (205) and the second flap (210) are retractable away from the bottom panel (260) of the inner tray (200) and the interior of the outer box (100) when the force is removed.

As shown in FIGS. 2A and 2B, the force applied to the first flap (205) and the second flap (210) may be caused by the first tab (105) and the second tab (110) of the outer box (100) being pushed down by the user. The first flap (205) and the second flap (210) may be in a first position or a second position. When the first tab (105) and the second tab (110) are not pushed down by the user, the first flap (205) and the second flap (210) are in a first position.

In the first position, the first flap (205) and the second flap (210) are in position where the first flap (205) and the second flap (210) are engaged with a first lip (155) formed in the interior of the outer box (100). In other words, the lengthwise (longer side) dimension of the first lip (155) is so that the first lip (155) extends on the interior top surface of the bottom panel of the outer box (100) to be in close proximity of the first tab 105 and the second tab 110 to meet, by abutting, the first flap (205) and the second flap (210) of the inner tray (200) when the inner tray is inserted into the outer box (100), and the first flap (205) and the second flap (210) may be positioned to be able to come into contact with the first tab (105) and the second tab (110), resulting in locking of the inner tray (200) inside the outer box (100) until the first tab (105) and the second tab (110), which are positioned to contact the first flap (205) and the second flap (210) of the inner tray (200), may be pressed against first flap (205) and the second flap (210) of the inner tray (200) to release the first flap (205) and the second flap (210) of the inner tray (200) from abutting the first lip (155), allowing the inner tray (200) to be slid out from the outer box (100). That is, if a user tries to slide out the inner tray (200) from the outer box (100), the first flap (205) and the second flap (210) collide with the first lip (155) causing the inner tray (200) to be locked in the outer box (100). The first lip (155) is glued to the interior side of the bottom panel (115) of the outer box (100). The first lip (155) also provides reinforcement for the outer box improving its ability to be tamper resistant.

As shown in FIG. 2A and FIG. 2B, when the inner tray (200) is properly inserted into the outer box (100) and first tab (105) and the second tab (110) are pushed down by the user, the first flap (205) and the second flap (210) are in a second position.

In the second position, the first flap (205) and the second flap (210) are in a position where the first flap (205) and the second flap (210) are positioned below the first lip (155). That is, the force of the first tab (105) and the second tab (110) pushes the first flap (205) and the second flap (210) down, so that when the user pulls out the inner tray (200) from the outer box (100) with the first tab (105) and the second tab (110) pushed down, the first flap (205) and the second flap (210) do not collide with the first lip (155). As such, the user is able to pull the inner tray (200) out of the outer box (100) so that the user can access the insert tray, as shown in FIG. 1B and FIG. 2B.

FIG. 2A, is a depiction of a user applying a force to the first tab (105) and the second tab (110) which moves the first tab (105) and the second tab (110) toward the interior of the outer box (100) to unlock the inner tray (200) from the outer box (100), according to an example. The size of the first tab and the second tab may be designed for human finger (e.g., adult fingers)

FIG. 2B, is a depiction of a user utilizing the first tab (105) and the second tab (110) to unlock the inner tray (200) from the outer box (100), according to an example. While the user applies pressure to the first tab (105) and second tab (110), the user is able to pull out the inner tray (200) from the outer box (100).

The inner tray (200) also includes a cover flap (290) to cover and uncover the tray insert (250). When the inner tray (200) is properly inserted into the outer box (100) so that inner tray (200) is lockable to the outer box (100), the bottom panel (260) of the inner tray (200) is adjacent to the bottom panel (115) of the outer box (100). This enables the first tab (105) and the second tab (110) to be in the first position and second position. In the first position, the first flap (205) and the second flap (210) engage with the first lip (155) of the outer box (100) to lock the inner tray (200) from sliding out of the outer box (100). In the second position, the first tab (105) and the second tab (110) push the first flap (205) and second flap (210) toward the interior of the outer box against the bottom panel of the inner tray (200), so that the first flap (205) and the second flap (210) are not engaged with the first lip (155) of the outer box (100) and the inner tray (200) is slideable out of the outer box (100).

When the inner tray (200) is properly inserted into the outer box (100), the bottom panel (260) of the inner tray (200) is directly under bottom panel (115) of the outer box (100) and the cover flap (290) of the inner tray (200) lays directly beneath the top panel (125) of the outer box (100).

Also when the inner tray (200) is properly inserted into the outer box (100), the first tab (105) and the second tab (110) of the outer box (100) are positioned directly above the first flap (205) and the second flap (210) of the inner tray (200), respectively.

When the inner tray (200) is inserted into the outer box (100), the open end of the outer box (100) is the front of the package and the first flap (135) and the second flap (145) are on the bottom side of the package. The bottom panel (115) of the outer box (100) is the bottom of the package and the top panel (125) of the outer box is the top of the package.

FIG. 1B is a depiction of the inner tray (200), according to an example. As shown in FIG. 1B, the inner tray (200) is slidable out of the outer box (100). That is, the inner tray (200) is unlocked from the outer box (100) by utilizing the first tab (105) and the second tab (110). When the inner tray (200) is lid out of the outer box (100), a user is able to move a cover flap (290) to cover and uncover the tray insert (250).

Figure 7:
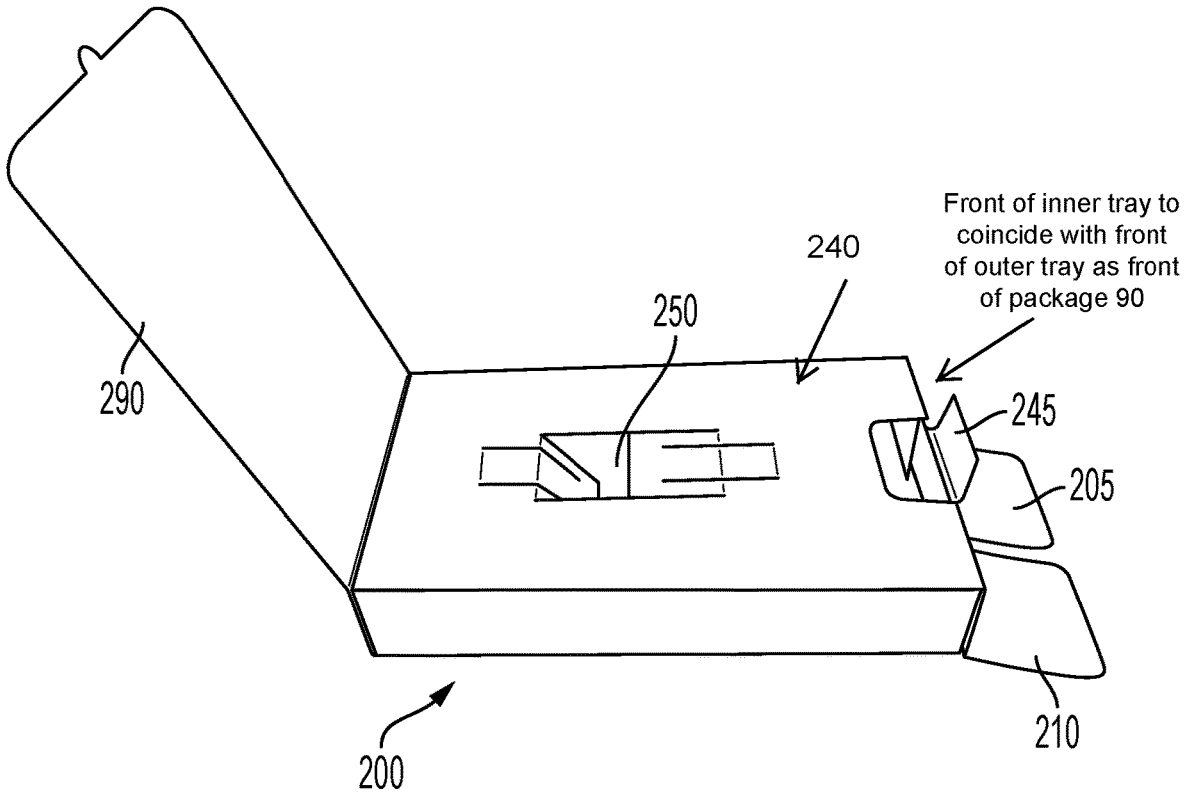
FIG. 7 is a view of the inner tray, according to an example.

FIG. 7 is a depiction of the inner tray (200), according to an example. According to the example, FIG. 7 shows the cover flap (290) of the inner tray (200) that is used to cover and uncover the tray insert (250). Likewise, the third flap (245) is shown. The third flap (245) enables the inner tray (200) from being complete removed from the outer box (100) when the third flap (245) catches the second lip (165).

Figure 8A:
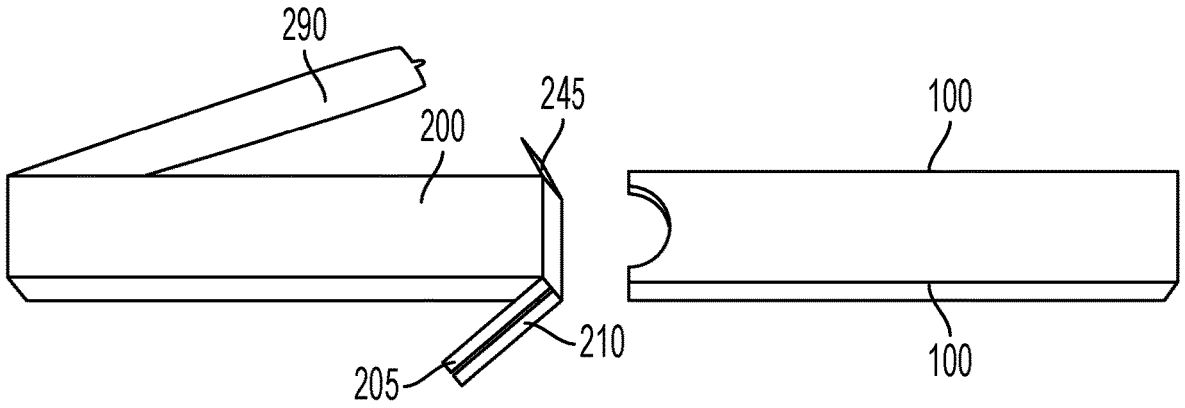
FIG. 8A is a view of the inner tray separated from the outer box, according to an example.
Figure 8B:
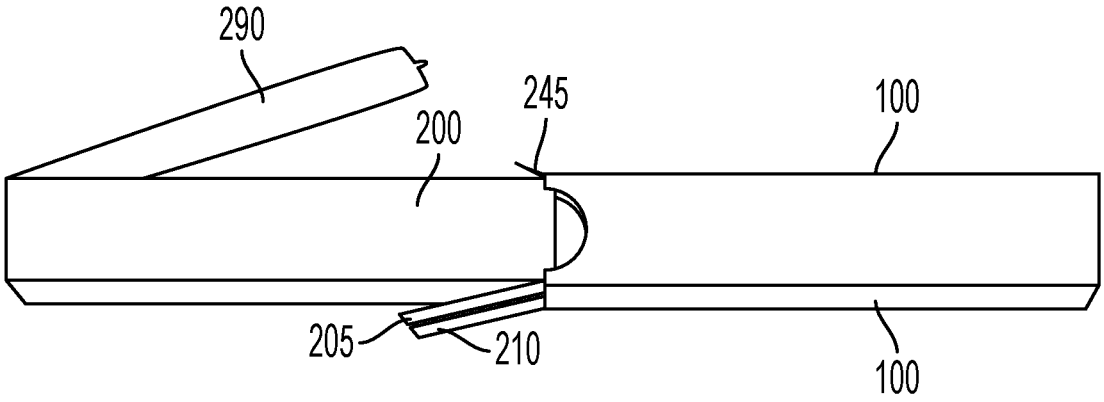
FIG. 8B is a view of the inner tray partially inserted into the outer box, according to an example.
Figure 8C:
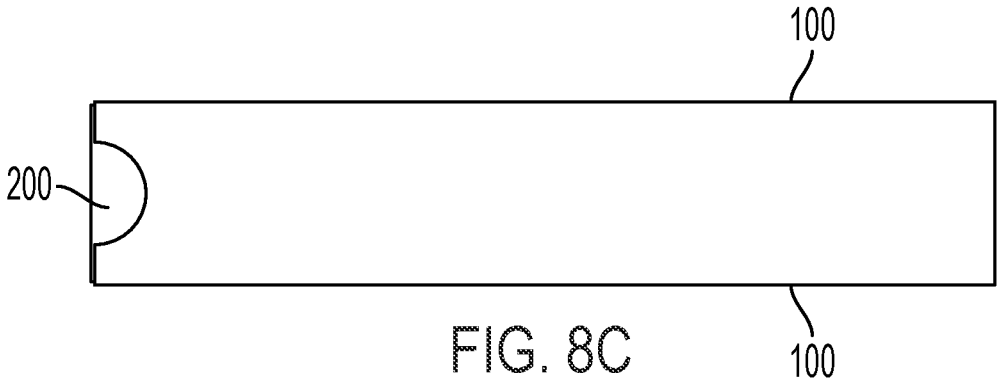
FIG. 8C is a view of the inner tray completely inserted into the outer box, according to an example.

FIG. 8A is a view of the inner tray (200) completely removed from the outer box (100), according to an example. Likewise, the cover flap (290), first flap (205), second flap (210) and the third flap (245) are shown. As shown the third flap (245), the first flap (205), and the second flap (210) are positioned on an opposite end of the inner tray (200). Likewise, FIG. 8A, FIG. 8B, and FIG. 8C show the proper orientation of the outer box and the inner tray. The proper orientation of the outer box and the inner tray enables the first flap (205), the second flap (210), the first tab (105), the second tab (110), the first lip (155) to act as members of the locking mechanism.

FIG. 8B shows the inner tray (200) partially inserted into the outer box (100), according to an example. Likewise, the cover flap (290), first flap (205), second flap (210) and the third flap (245) are shown. As shown, in the FIG. 8B the first flap (205) and second flap (210) are positioned on the bottom side of the outer box (100) while the cover flap (290) is positioned on the top side of the outer box (100).

FIG. 8C shows the inner tray (200) fully inserted into the outer box (100), according to an example.

The first flap (205) and the second flap (210) of the inner tray (200) may be laminate or other similar material. This enables the first flap and second flap to have buoyance and not lay completely flat along the bottom panel (260).

The inner tray (200) and the outer box (100) include polyethylene terephthalate or other similar material.

A surface forming the cuboid shape of the outer box (100) is quadrilateral.

The bottom panel (260) of the inner tray (200) includes a third flap (245), the third flap (245) preventing the inner tray (200) from being completely withdrawn from the outer box (100).

When fully assembled the package allows for the inner tray (200) to be insertable into and out of the outer box (100). The package's locking mechanism and construction makes accessing the contents of the inner tray difficult for users such as children.

For instance, when fully assembled the first tab (105) and second tab (110) of the outer box (100) and the first flap (205) and second flap (210) of the inner tray (200) and the first lip (155) of the outer box (100) act together as locking mechanism preventing the inner tray (200) from being pulled or slid out of the outer box (100).

Since the package locking mechanism is part of the outer box (100) and the inner tray (200), no other external component is needed as a locking mechanism. This reduces the production cost of the package and also improves the appearance of the package. The structure and position of the locking mechanism allows for efficient use of outer box for labeling and advertising. In fact, advertisements and labeling can be directly printed onto the outer box (100) and inner tray (200).

In the example embodiments of the package, the outer box (100) is made from a single piece of paperboard that is foldable, the inner tray (200) is made from a single piece of paperboard that is foldable. For example, the paperboard could be 400 gsm (grams per square meter) Paperboard or other similar variations.

Referring to FIG. 5B, the outer box (100) includes a bottom panel (115) of the outer box (100) being rectangular shaped and including a back edge (115*a*), a front edge (115*c*), a first side edge (115*b*) and a second side edge (115*d*). The back edge (115*a*) having a fold line, the front edge (115*c*) having a fold line, the first side edge (115*b*) having a fold line, and the second side edge (115*d*) having a fold line. The bottom panel (115) of the outer box (100) also having a first cut and a second cut formed in the panel to form the first tab (105) and the second tab (110).

The outer box (100) includes a top panel (125) of the outer box (100) being rectangular shaped and including a back edge (125*a*), a front edge (125*c*), a first side edge (125*b*), and a second side edge (125*d*). The back edge (125*a*) having a fold line extending along the back edge (125*a*), the front edge (125*c*) having a fold line extending along the front edge (125*c*), the first side edge (125*b*) having a fold line extending along the first side edge (125*b*), and the second side edge (125*d*) having a fold line extending along the second side edge (125*d*).

The outer box (100) includes a first side wall (120) being rectangular shaped and including a back edge (120*a*), a front edge (120*c*), a first side edge (120*b*), a second side edge (120*d*). The back edge (120*a*) having a fold line extending along the back edge (120*a*), a front edge (120*c*) having a fold line extending along the front edge (120*c*), a first side edge (120*b*) having a fold line extending along the first side edge (120*b*), and a second side edge (120*d*) having a fold line extending along the second side edge (120*d*). The first side wall (120) having a portion of a first circle (175) cut into the first side wall (120). A portion of the first circle cut into the first side wall (120) starts along the second side edge (120*d*). The first circle (175) forming a first finger hold (175*a*) for the user to pull out the inner tray (200).

The outer box (100) includes a second side wall (130) being rectangular shaped and including a back edge (130*a*), a front edge (130*c*), a first side edge (130*b*), and a second side edge (130*d*). The back edge (130*a*) having a fold line extending along the back edge (130*a*), a front edge (130*c*) having a fold line extending along the front edge (130*c*), a first side edge (130*b*) having a fold line extending along the first side edge (130*b*), and a second side edge (130*d*) having a fold line extending along the second side edge (130*d*). The second side wall (130) having a portion of second circle (180) cut into the second side wall (130). A portion of the second circle cut into the second side wall starting at the second side edge (130*d*). The second circle (180) forming second finger hold (180*a*) for the user to pull out the inner tray (200).

The outer box (100) includes a glue panel (185) being rectangular shaped and including a back edge (185*a*), a front edge (185*c*), a first side edge (185*b*), a second side edge (185*d*). The front edge (185*c*) having a fold line extending along the front edge (185*c*). The glue panel (185) have a semi-circle shape cut into the glue panel (185). The semi-circle shape cut starting at the second side edge (185*d*).

The outer box (100) includes a first flap (135). The first flap (135) including a first side edge (135*a*) and a second side edge (135*b*). The first side edge (135*a*) having a fold line extending along the first side edge (135*a*). The first side edge (135*a*) being formed next to the first side edge (115*b*) of the bottom panel (115) of the outer box (100).

The outer box (100) includes a second flap (145). The second flap (145) including a first side edge (145*a*) and a second side edge (145*b*). The first side edge (145*a*) having a fold line extending along the first side edge (145*a*). The first side edge (145*a*) being formed next to the first side edge (125*b*) of the top panel (125) of the outer box (100).

The outer box (100) includes a first dog ear (140). The first dog ear (140) being rectangular shaped and including a back edge (140*a*), a front edge (140*c*), a first side edge (140*b*), and a second side edge (140*d*). The second side edge (140*d*) having a fold line extending along the second side edge (140*d*). The second side edge (140*d*) being formed next to the first side edge (120*b*) of the first side wall (120).

The outer box (100) includes a second dog ear (150). The second dog ear (150) being rectangular shaped and including a back edge (150*a*), a front edge (150*c*), a first side edge (150*b*), and a second side edge (150*d*). The second side edge (150*d*) having a fold line extending along the second side edge (150*d*). The second side edge (150*d*) being formed next to the first side edge (130*b*) of the second side wall (130).

The outer box (100) includes a first lip (155). The first lip (155) being rectangular shaped and including a back edge (155*a*), a front edge (155*c*), a first side edge (155*b*), and a second side edge (155*d*). The first side edge (155*b*) having a fold line extending along the first side edge (155*b*). The first side edge (150*b*) being formed next to the second side edge (115*d*) of the bottom panel (115) of the outer box (100). The first lip (155) may be glued or connected by adhesive or film adhesive to the bottom panel (115) of the outer box (100), so that the first lip is positioned in the interior of the outer box (100) and protrudes toward the interior of the outer box (100).

The outer box (100) includes a third dog ear (160). The third dog ear (160) being rectangular shaped and including a back edge (160*a*), a front edge (160*c*), a first side edge (160*b*), and a second side edge (160*d*). The first side edge (160*b*) having a fold line extending along a first portion of the first side edge (160*b*) and a second portion of the first side edge (160*b*). The first side edge (160*b*) being formed next to the second side edge (120*d*) of the first side wall (120). The third dog ear (160) having a portion of the first circle (175) cut into the third dog ear (160). A portion of the first circle cut into the third dog ear (160) starting at the first side edge (160*b*).

The outer box (100) includes a second lip (165). The second lip (165) being rectangular shaped and including a back edge (165*a*), a front edge (165*c*), a first side edge (165*b*), and a second side edge (165*d*). The first side edge (165*b*) having a fold line extending along the first side edge (165*b*). The first side edge (165*b*) being formed next to the second side edge (125*d*) of the top panel (125) of the outer box (100). The second lip (165) may be glued or connected by a film adhesive or adhesive to the interior top surface of the top panel (125) of the outer box (100), so that the second lip is positioned in the interior of the outer box (100) and protrudes toward the interior of the outer box (100).

The outer box (100) includes a fourth dog ear (170). The fourth dog ear (170) being rectangular shaped and including a back edge (170*a*), a front edge (170*c*), a first side edge (170*b*), and a second side edge (170*d*). The first side edge (170*b*) having a fold line extending along a first portion the first side edge and along a second portion of the second side edge. The first side edge (170*b*) being formed next to the second side edge (130*d*) of the second side wall (130). The fourth dog ear (170) having a portion of the second circle (180) cut into the fourth dog ear (170). A portion of the second circle cut into the fourth dog ear (170) starting at the first side edge (170*b*).

The outer box (100) is assembled by folding the first lip (155) onto an interior top surface of the bottom panel (115) of the outer box (100) along the fold line of the second side edge (115*d*). The first lip (155) is then attached onto the bottom panel (115) of the outer box (100) with film adhesive or adhesive. The second lip (165) is folded onto the top panel (125) of the outer box (100) along the folding line of the first side edge (165*b*). The second lip (165) is then attached onto the top panel (125) of the outer box (100) with film adhesive or adhesive.

The second side wall (130) is attached to the glue panel (185) with film adhesive or adhesive, so that the top panel (125) of the outer box (100) and the bottom panel (115) of the outer box (100) are in parallel with each other and the first side wall (120) and the second side wall (130) are in parallel with each other.

Additionally, the first dog ear (140) is attached to the first side wall (120) with film adhesive or adhesive by being folded onto the first side wall (120).

The second dog ear (150) is attached to the glue panel (185) with film adhesive or adhesive by being folded onto glue panel (185) and a portion of the glue panel 185 is positioned between the second dog ear (150) and the second side wall (130).

The third dog ear (160) is attached to the first side wall (120) with film adhesive or adhesive by being folded onto the first side wall (120).

The fourth dog ear (170) is attached to the glue panel (185) with film adhesive or adhesive by being folded onto the glue panel (185). A portion of glue panel (185) is positioned between the fourth dog ear (170) and the second side wall (130).

The first flap (135) is attached to the second flap (145) with film adhesive or adhesive so that an end of the outer box (100) is closed. This closed end may be referred to as the back of the package. While the open end of the outer box (100) may be referred to the open end.

Referring to FIG. 4B, the inner tray (200) includes a first side wall (235) being rectangular shaped and including a back edge (235*a*), a front edge (235*c*), a first side edge (235*b*), and a second side edge (235*d*). The front edge (235*c*) having fold lines extending along the front edge (235*c*). The first side edge (235*b*) having fold lines extending along the first side edge (235*b*). The second side edge (235*d*) having fold lines extending along the second side edge (235*d*).

The inner tray (200) includes a top panel (240) being rectangular shaped and including a back edge (240*a*), a front edge (240*c*), a first side edge (240*b*), and a second side edge (240*d*). The back edge (240*a*) having a fold line extending along the back edge (240*a*). The front edge (240*c*) having a fold line extending along the front edge (240*c*). The first side edge (240*b*) having a fold line extending along the first side edge (240*b*). The second side edge (240*d*) having a fold line extending along the second side edge (240*d*).

The top panel (240) also includes a tray insert (250) formed in the top panel (240). The tray insert (250) formed by cut lines and fold lines in the top panel (240). The tray insert (25) receives items so that the items be held in the inner tray (200) securely.

The top panel (240) also includes a third flap (245) formed along the top panel (240). The third flap (245) formed by cut lines along the top panel.

The inner tray (200) includes a second side wall (255) being rectangular shaped and including a back edge (255*a*), a front edge (255*c*), a first side edge (255*b*), and a second side edge (255*d*). The back edge (255*a*) having a fold line extending along the back edge (255*a*). The front edge (255*c*) having a fold line extending along the front edge (255*c*). The first side edge (255*b*) having a fold line extending along the first side edge (255*b*). The second side edge (255*d*) having a fold line extending along the second side edge (255*d*).

The inner tray (200) includes a bottom panel (260) being rectangular shaped and including a back edge (260*a*), a front edge (260*c*), a first side edge (260*b*), and a second side edge (260*d*). The back edge (260*a*) having a fold line extending along the back edge (260*a*). The front edge (260*c*) having a fold line extending along the front edge (260*c*). The first side edge (260*b*) having a fold line extending along the first side edge (260*b*). The second side edge (260*d*) having a fold line extending along the first side edge (260*b*).

The inner tray (200) includes a glue panel (265) including a back edge (265*a*), a front edge (265*c*), a first side edge (265*b*), and a second side edge (265*d*). The back edge (265*a*) having a fold line extending along the back edge (265*a*). The glue panel (265) having film adhesive or adhesive.

The inner tray (200) includes a first flap (205) and a second flap (210). The first flap (205) including a back edge (205*a*), a front edge (205*c*), a first side edge (205*b*), and a second side edge (205*d*). The second side edge (205*d*) having a fold line extending along the second side edge (205*d*).

The second flap (210) including a back edge (210*a*), a front edge (210*c*), a first side edge (210*b*), and a second side edge (210*d*). The second side edge (210*d*) having a fold line extending along the second side edge (210*d*).

The inner tray (200) includes a first dog ear (215). The first dog ear (215) including a back edge (215*a*), a front edge (215*c*), a first side edge (215*b*), and a second side edge (215*d*). The second side edge (215*d*) having a fold line extending along the second side edge (215*d*).

The inner tray (200) includes a first side panel (220). The first side panel (220) being rectangular shaped and including a back edge (220*a*), a front edge (220*c*), a first side edge (220*b*), and a second side edge (220*d*). The second side edge (220*d*) having a fold line extending along the second side edge (220*d*). The first side edge (220*b*) have a first fold line extending along a portion the first side edge (220*b*) and a second fold line extending along another portion of the first side edge (220*b*).

The first flap (205) and the second flap (210) formed off the first side edge (220*b*) of the first side panel.

The inner tray (200) includes a second dog ear (225). The second dog ear (225) including a back edge (225*a*), a front edge (225*c*), a first side edge (225*b*), and a second side edge (225*d*). The second side edge (225*d*) having a fold line extending along the second side edge (225*d*).

The inner tray (200) includes a second side panel (230). The second side panel (230) including a back edge (230*a*), a front edge (230*c*), a first side edge (230*b*), and a second side edge (230*d*). The second side edge (230*d*) having a fold line extending along the second side edge (230*d*).

The inner tray (200) includes a third dog ear (270). The third dog ear (270) including a back edge (270*a*), a front edge (270*c*), a first side edge (270*b*), and a second side edge (270*d*). The first side edge (270*b*) having a fold line.

The inner tray (200) includes a third side panel (275). The third side panel (275) including a back edge (275*a*), a front edge (275*c*), a first side edge (275*b*), and a second side edge (275*d*). The first side edge (275*b*) having a fold line extending along the first side edge (275*b*).

The inner tray (200) includes a fourth dog ear (280). The fourth dog ear (280) including a back edge (280*a*), a front edge (280*c*), a first side edge (280*b*), and a second side edge (280*d*). The first side edge (280*b*) having a fold line extending along the first side edge (280*b*).

The inner tray (200) includes a fourth side panel (285). The fourth side panel (285) including a back edge (285*a*), a front edge (285*c*), a first side edge (285*b*), and a second side edge (285*d*). The first side edge (285*b*) having a fold line extending along the first side edge (285*b*). The second side edge (285*d*) having a fold line extending along the second side edge (285*d*).

The inner tray (200) includes a cover flap (290). The cover flap (290) including a back edge (290*a*) and a first side edge (290*b*). The first side edge (290*b*) having a first fold line extending along the first side edge (290*b*). The cover flap (290) including a second fold line (290*d*) spaced apart from the first fold line and in parallel with the first fold line and extending along the cover flap (290).

The inner tray (200) is assembled by attaching the glue panel (265) to the first side wall (235) with film adhesive or adhesive, so that bottom panel (260) is in parallel with top panel (240) and the first side wall (235) is in parallel with the second side wall (255). The first side wall (235) connected to the glue panel (265) by film adhesive or adhesive.

The first dog ear (215) is attached to a portion of the glue panel (265) by film adhesive or adhesive. A portion of the glue panel (265) is positioned between the first side wall (235) and the first dog ear (215).

The third dog ear (270) is attached to another portion of glue panel (265) by an adhesive or film adhesive. Another portion of the glue panel (265) is positioned between the first side wall (235) the third dog ear (270).

The second dog ear (225) is attached to the second side wall (255) by film adhesive or an adhesive. The fourth dog ear (280) is attached to the second side wall (255) by an adhesive or film adhesive. The third side panel (275) is attached to the fourth side panel (285) by and adhesive or film adhesive so that an end of the inner tray is closed and a cover flap (290) is positioned to lay over the top panel (240). The second side panel (230) is attached to the first side panel (220) with adhesive or film adhesive so that first flap (205) and the second flap (210) lay over the bottom panel (260).

Elements of the inner tray (200) such as the first flap (205) and the second flap 210 may have adhesive or adhesive film applied in bidirectional manner. For example, the adhesive or adhesive film may be applied along the second side panel (230) and a portion of the bottom panel (260) so the first flap (205) and second flap (210) are not easily ripped apart.

Likewise, the cover flap (290) of the inner tray (200) may also have adhesive or adhesive film applied in bidirectional way. For example, the adhesive or adhesive film may be applied along the third side panel (275) and top panel (240). This also enables the cover flap (290) from being easily ripped apart from the inner tray.

This bidirectional application of adhesive or adhesive film can be applied on other portions of the outer box and inner tray as well The package may include 400 gsm (grams per square meter) Paperboard. In an example, a 24 pt (point) paperboard with a tear resistant, matte polyethylene terephthalate (PET) and nylon laminate or other similar material can be used for the material of the foldable outer box and the foldable inner tray. For example, the outer box may be laminate.

Utilizing material such as paperboard, fiberboard, or stock instead of cardboard allows printing to occur directly on the paperboard, fiberboard, or stock. This printing process is a more efficient printing processing printing the turned edge printing and case bound printing used on cardboard boxes.

The package may have varying dimensions. In an example, dimensions of the package 90 may be about 4.7"×about 2.8"×about 1", about 400 (gsm). In an example, higher rigidity of the material of the first flap 205, the second flap 210 and the third flap 245, may increase the locking strength.

The Inner tray may be constructed from a single piece paperboard, fiberboard, or stock. Likewise, the outer box may be constructed from a single piece of paper, fiberboard, or stock. These single piece of paperboard, fiberboard, or stock used to make the inner tray and outer box may be cut by cut and assembled by machines (such an automatic assemble partition machine and other similar machines).

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

The words "a," "an" and "the" are intended to include plural forms of elements unless specifically referenced as a single element. The term "at least" preceding a listing of elements denotes any one or any combination of the elements in the listing. In other words, the expression "at least one of . . . " when preceding a list of elements, modifies the entire list of elements and does not modify the individual elements of the list.

The term of "and/or" includes a plurality of combinations of relevant items or any one item among a plurality of relevant items.

The terms "comprise(ing)," "include(ing)," and "have (ing)" when used in this specification, specify the presence of stated features, functions, processes/operations, elements, and/or components, but do not preclude the presence or addition of one or more other features, functions, processes/operations, elements, components, and/or groups thereof.

In the specification, when an element is "coupled" to another element, the elements may not only be "directly connected", but may also be "connected" via another element therebetween. The "coupling" may be mechanical, electrical, optical and/or by way of data communication. Also, when a region "includes" an element, the region may further include another element instead of excluding the other element, unless otherwise differently stated.

While this disclosure has been shown and described with reference to examples thereof, it will be understood by one of ordinary skill in the art that various changes in form and details may be made therein without departing from the scope as defined by the claims.

The invention claimed is:

1. A package comprising:

an outer box having a cuboid shape and including, a top panel of the outer box, a bottom panel of the outer box having, a first tab and a second tab positioned on an outer surface of the bottom panel, the first tab and the second tab movable toward an interior of the outer box when a force is applied on the first tab and the second tab, the first tab and the second tab retractable away from the interior of the outer box when the force is removed, and a folded panel configured to form a first lip along an interior top surface of the bottom panel to protrude towards the interior of the outer box, and an open side; and an inner tray having a cuboid shape and slidable into and out of the outer box through the open side of the outer box, the inner tray including, a top panel, a bottom panel of the inner tray being in parallel with the top panel of the inner tray, and a first flap and a second flap formed along the bottom panel of the inner tray, the first flap and the second flap movable toward a surface of the bottom panel of the inner tray when a force is applied on the first flap and the second flap during insertion of the inner tray into the outer box, wherein, when the inner tray is inserted into the outer box with the bottom panel of the inner tray being adjacent to the interior top surface of the bottom panel of the outer box, and the first tab and the second tab are in a first position, the first flap and the second flap engage with the first lip of the outer box to lock the inner tray from sliding out of the outer box, and when the first tab and the second tab are in a second position, the first tab and the second tab push the first flap and second flap toward the interior of the outer box against the bottom panel of the inner tray, so that the first flap and the second flap are not engaged with the first lip of the outer box and the inner tray is slideable out of the outer box.

2. The package of claim 1, wherein the outer box and the inner tray include about 400 gsm paperboard.

3. The package of claim 1, wherein the first flap and the second flap are laminate.

4. The package of claim 1, wherein the inner tray and the outer box include polyethylene terephthalate.

5. The package of claim 1, wherein a surface forming the cuboid shape of the outer box is quadrilateral.

6. The package of claim 1, wherein the top panel of the inner tray includes a third flap, the third flap to engage a second lip on an interior top surface of the top panel of the outer box, resulting in preventing the inner tray from being completely withdrawn from the outer box.

7. The package of claim 1, wherein the top panel of the inner tray includes a tray insert to hold an item.

8. A package having a cuboid shape, comprising:

an outer box including, a first tab, a second tab, the first tab and the second tab moveable towards an interior of the outer box, and a folded panel configured to form a first lip disposed on a top surface of a bottom panel of the outer box; and an inner tray slidable into and out of the outer box, the inner tray including, a first flap, and a second flap, the first flap and the second flap respectively engageable with the first tab and the second tab, so that when a force is applied on the first tab and the second tab, the first tab and the second tab respectively come into contact with the first flap and the second flap be respectively moved toward the interior of the outer box against thea bottom panel of the inner tray to disengage from the first lip, causing the inner tray to be unlocked and slidable out of the outer box, and when the force is not applied to the first tab and the second tab, the first flap and the second flap are engaged with the first lip causing the inner tray to be locked inside the outer box.

9. The package according to claim 8, wherein a top panel of the inner tray includes a third flap, the third flap to engage a second lip on an interior top surface of the top panel of the outer box, resulting in preventing the inner tray from being completely withdrawn from the outer box.

* * * * *